US012320564B2

(12) United States Patent
Jalia et al.

(10) Patent No.: US 12,320,564 B2
(45) Date of Patent: Jun. 3, 2025

(54) DEVICE AND METHOD FOR PRE-COOLING A STREAM OF GAS

(71) Applicant: ENGIE, Courbevoie (FR)

(72) Inventors: Florian Jalia, Courbevoie (FR); Hamza Filali, Courbevoie (FR); Audrey Hubert, Courbevoie (FR)

( * ) Notice: Subject to any disclaimer, the term of this patent is extended or adjusted under 35 U.S.C. 154(b) by 44 days.

(21) Appl. No.: 18/256,052

(22) PCT Filed: Dec. 10, 2021

(86) PCT No.: PCT/EP2021/085174
§ 371 (c)(1),
(2) Date: Jun. 6, 2023

(87) PCT Pub. No.: WO2022/128780
PCT Pub. Date: Jun. 23, 2022

(65) Prior Publication Data

US 2024/0093924 A1 Mar. 21, 2024

(30) Foreign Application Priority Data

Dec. 15, 2020 (FR) ..... 2013265

(51) Int. Cl.
*F25B 41/42* (2021.01)
*F25B 9/00* (2006.01)
(Continued)

(52) U.S. Cl.
CPC ..... *F25B 41/42* (2021.01); *F25B 9/002* (2013.01); *F25B 41/39* (2021.01); *F25B 9/10* (2013.01);
(Continued)

(58) Field of Classification Search
CPC ..... F25B 41/42; F25B 9/10; F25J 1/0072
See application file for complete search history.

(56) References Cited

U.S. PATENT DOCUMENTS 5,579,655 A 12/1996 Grenier
2014/0245780 A1 9/2014 Wyllie et al.
(Continued)

OTHER PUBLICATIONS

International Search Report; NL; Mar. 15, 2022.
(Continued)

*Primary Examiner* — Lionel Nouketcha
(74) *Attorney, Agent, or Firm* — Patshegen IP; Moshe Pinchas

(57) ABSTRACT

The device (100) for pre-cooling a flow of a gas comprises:
- a separator (135) of a coolant flow (125), downstream from a compressor (155), into two flows:
- one coolant flow (140) referred to as "medium-pressure"; and
- one coolant flow (145) referred to as "low-pressure";
- a first exchanger (105) exchanging heat between the flow (120) of the gas to be pre-cooled and at least the medium-pressure coolant flow (140) comprising at least nitrogen;
- an expander (150) of the low-pressure coolant flow;
- a second exchanger (110) exchanging heat between the flow of a gas and the expanded low-pressure coolant flow on output from the second expander; and
- a third exchanger (115) exchanging heat between the flow of a gas and the low-pressure coolant flow on output from the second heat exchanger.

14 Claims, 4 Drawing Sheets

(51) Int. Cl.
*F25B 9/10* (2006.01)
*F25B 41/39* (2021.01)

(52) U.S. Cl.
CPC ..... *F25B 2313/031* (2013.01); *F25B 2500/05* (2013.01)

(56) References Cited

U.S. PATENT DOCUMENTS

| | | | | |
|---|---|---|---|---|
| 2015/0204603 | A1 | 7/2015 | Sheng | |
| 2019/0063824 | A1 | 2/2019 | Watanabe et al. | |
| 2020/0064060 | A1 * | 2/2020 | Pierre, Jr. ..... | F25J 1/0268 |

OTHER PUBLICATIONS

Jingxuan Xu, Wensheng Lin; Research on systems for producing liquid hydrogen and LNG from hydrogen-methane mixtures with hydrogen expansion refrigeration; International Journal of Hydrogen Energy; vol. 46 No. 57, Nov. 20, 2020, pp. 29243-29260.

* cited by examiner

DEVICE AND METHOD FOR PRE-COOLING A STREAM OF GAS

TECHNICAL FIELD OF THE INVENTION

The present invention relates to a device for pre-cooling a flow of a gas and a method for pre-cooling a flow of a gas. It applies, for example, to the field of cooling a gas, prior to its liquefaction, and in particular hydrogen.

STATE OF THE ART

The liquefaction method is divided into three large technological blocks of temperature: compression, pre-cooling and cooling. The purpose of the pre-cooling is to lower the input temperatures of the fluid of interest and of the fluid serving for cooling in the following block, from a range of 273 K to 320 K down to a temperature referred to as pre-cooling in the range 78 K to 120 K.

The following prior systems are known:

Historically, the pre-cooling operation is carried out with liquid nitrogen flowing in counterflow in a heat exchanger. This enters at a temperature of about 78 K, exits at ambient temperature and is released to the atmosphere.

Another known method recycles the nitrogen used, cooling it by means of a series of compressions, cooling, with a final expansion making it possible to reduce the temperature of the gas to approximately 80 K as well. By means of a heat exchanger, the fluids to be cooled are brought to approximately 80 K as well.

One improvement of this loop recommends carrying out several expansions during the cooling, making it possible to optimise the supply of cold temperatures within the exchangers.

Lastly, a method known under the name of "MRC" (for "Mixed-Refrigerant Cycle") uses a mixture of hydrocarbons and nitrogen as coolant, whose composition varies according to the publications and patents. By the same operating principle of compression, cooling, expansion, the coolant is cooled to approximately 110 K. By means of a heat exchanger, the fluids to be cooled are brought to approximately 110 K as well.

All these existing systems have drawbacks:

The open loop of liquid nitrogen has the drawback of entailing logistics management of its nitrogen supply and storage and having low energy efficiency (about 3.5 to 4.5 kWh/kg LH2). Its economic and practical advantage is justified in the context of a small production of less than 5 tonnes a day, but is non-viable and operationally complex above that. Above a certain capacity, for example above 5 or 10 tonnes a day, and depending on the choice of the technology, the amount of liquid nitrogen needed is unsuitable for an economically viable supply chain.

The three other solutions are all alternatives to the nitrogen open loop solution in that they operate in a closed cycle, avoiding all the problems mentioned previously.

The nitrogen closed cycle solution, and its improvement, require significant investments in equipment, especially compressors, because of their high nitrogen flow rate.

Patent applications U.S. Pat. No. 5,579,655 and US 2019/063 824 are known, which disclose nitrogen closed cycle devices for pre-cooling hydrogen. However, these devices require the use of liquid nitrogen, separated from gaseous nitrogen by means of a phase separator, in the flow of coolant fluid.

Patent applications US 2015/204 603 and US 2014/245 780 are also known, which disclose nitrogen closed cycle devices for the liquefaction of natural gas to obtain liquefied natural gas. However, these devices do not allow pre-cooling to be carried out without the liquefaction of the natural gas.

Lastly, the MRC solution optimises the energy efficiency of the cycle but adds complexity in the management of the many components of the coolant ranging from 4 to 15. This is due in particular to the fact that the composition is changing throughout the use of the process because of leaks. The initial composition therefore needs to be reconstituted by introducing the various hydrocarbons, which will need to be stored in advance. In addition, the leaks of hydrocarbon gases are significant contributors to greenhouse gas emissions.

Consequently, there is currently no simple solution with regard to the coolant fluid supply. Nor is there any efficient and cost-effective solution for pre-cooling a fluid, especially a gas, and hydrogen in particular.

PRESENTATION OF THE INVENTION

The present invention aims to remedy all or part of these drawbacks.

To this end, according to a first aspect, the present invention envisages a device for pre-cooling a flow of a gas, which comprises:

- downstream from a first coolant flow compressor, a first expander of at least one portion of a gaseous flow comprising at least nitrogen, referred to as "coolant flow";
- a separator of the gaseous coolant flow, downstream from the first compressor, into two gaseous flows:
- one coolant flow referred to as "medium-pressure"; and
- one coolant flow referred to as "low-pressure";
- a first exchanger exchanging heat between the flow of the gas to be pre-cooled and at least the medium-pressure gaseous coolant flow comprising at least nitrogen;
- a second expander of the low-pressure gaseous coolant flow;
- a second exchanger exchanging heat between the flow of a gas and the expanded low-pressure gaseous coolant flow on output from the second expander;
- a third exchanger exchanging heat between the flow of a gas and the low-pressure gaseous coolant flow on output from the second heat exchanger; and
- at least a first compressor of the expanded low-pressure gaseous coolant flow and the medium-pressure gaseous coolant flow on output from the first heat exchanger to form the high-pressure gaseous coolant flow.

Thanks to these provisions, the device that is the subject of the present invention performs the pre-cooling in a double loop under pressure. By doing this, the medium-pressure coolant flow makes it possible to reduce the energy dissipation (and therefore to reduce energy losses) occurring in the first heat exchanger due to a very large difference between the temperature on input of the cold fluid and the temperature on output of the warm fluid. By carrying out a fusion of the medium-pressure and low-pressure flows before the last compression stage, the invention makes it possible to avoid incorporating an additional compressor for bringing the flow from medium to high pressure.

The invention is of interest in the cases of production requiring operational autonomy since it dispenses with a regular supply of liquid nitrogen. In general, the technology becomes interesting when the purchase and transportation costs of the liquid nitrogen is greater than the extra cost of equipment due to the invention.

In addition, the solution has the advantage of reducing electrical consumption, which is an asset in line with two trends:

- the greater the capacity, the more interesting the technology; and
- the higher the electricity purchase costs, the more interesting the technology.

Lastly, the solution has the advantage of continuing to use nitrogen, whose toxicity and safety aspects are less dangerous than those of hydrocarbon-based mixed coolants. Therefore, the invention is also more suitable for use in peri-urban areas.

In some embodiments, the separator is positioned downstream from a passage of the coolant flow coming from the first compressor in the first heat exchanger, the first expander being positioned between the first heat exchanger and the separator.

In some embodiments, the separator is positioned upstream from the passage of the coolant flow coming from the first compressor in the first heat exchanger, the expander being configured to expand the coolant flow to medium pressure, this expander being positioned between the separator and the first heat exchanger.

These embodiments reduce the nitrogen flow rate (and further reduce the size of the compressors and the size of the heat exchangers). However, two expansion systems are therefore required, one with a single stage for the medium-pressure flow and the other with two stages for the low-pressure flow.

In some embodiments, the method that is the subject of the present invention comprises, upstream from the first compressor, an assembly of at least a second compressor of the low-pressure coolant flow on output from the first heat exchanger, the assembly of at least a second compressor being configured such that the low-pressure coolant flow is brought to a pressure equivalent to the pressure of the medium-pressure coolant flow on output from the first heat exchanger.

This solution also makes it possible to reduce the volumetric flow rate of the compressors of the compressor assembly by 30%, and therefore to reduce the energy consumption by the same amount (for example, achieving a "Specific Energy Consumption", abbreviation SEC, of approximately 1.8 kWh/kg LH2) and the initial investment in equipment. The price of the complete compression section of nitrogen with a compressor is lower than the price of two compressors with lower flow rates dedicated respectively to the medium- and low-pressure flow.

In some embodiments, the third heat exchanger is a catalytic exchanger. In some variants, the first exchanger is not a catalytic exchanger, and the second and third exchangers are combined in a single exchanger.

In some embodiments, the method that is the subject of the present invention comprises a mixer of the expanded low-pressure coolant flow and the medium-pressure coolant flow on output from the first heat exchanger to form a single coolant flow, the single flow being supplied to the first compressor.

These embodiments make it possible to avoid incorporating an additional compressor for bringing the flow from medium to high pressure.

In some embodiments, the first compressor is configured to produce a high-pressure coolant flow having a pressure between 40 and 60 bar.

These embodiments have optimum operating conditions for the pre-cooling of hydrogen.

In some embodiments, the first expander is configured to produce a medium-pressure coolant flow having a pressure between 15 and 23 bar.

These embodiments have optimum operating conditions for the liquefaction of hydrogen.

In some embodiments, the second expander is configured to produce a low-pressure coolant flow having a pressure between 1 and 2 bar.

These embodiments have optimum operating conditions for the liquefaction of hydrogen.

In some embodiments, the method that is the subject of the present invention comprises a sensor detecting the flow rate of a gas and a regulator regulating the flow rate of the coolant flow, the flow rate regulator being configured such that the flow rate of the coolant flow is equal to 26 to 40 times the flow rate of the gas.

These embodiments have optimum operating conditions for the liquefaction of hydrogen.

In some embodiments, the pre-cooled gas is dihydrogen.

In some embodiments, the pre-cooled gas has a temperature between 70 K and 120 K.

In some embodiments, the pre-cooled gas has a temperature between 78 K and 82 K.

According to a second aspect, the present invention envisages a method for pre-cooling a flow of a gas, which comprises:

- downstream from a first step of compressing a gaseous flow comprising at least nitrogen, referred to as "coolant flow", a first step of expanding at least one portion of the gaseous coolant flow,
- a step of separating the gaseous coolant flow, coming from the first compression step, into two gaseous flows:
  - one coolant flow referred to as "medium-pressure"; and
  - one coolant flow referred to as "low-pressure";
- a first step of exchanging heat between the flow of a gas to be pre-cooled and at least the medium-pressure gaseous coolant flow comprising at least nitrogen;
- a second step of expanding the low-pressure gaseous coolant flow;
- a second step of exchanging heat between the flow of a gas and the expanded low-pressure gaseous coolant flow on output from the second expansion step;
- a third step of exchanging heat between the gas flow and the low-pressure gaseous coolant flow on output from the second heat exchange step; and
- at least a first step of compressing the expanded low-pressure gaseous coolant flow and the medium-pressure gaseous coolant flow on output from the first heat exchange step to form the high-pressure gaseous coolant flow, the high-pressure gaseous coolant flow being supplied to the first heat exchange step.

The advantages of the method that is the subject of the present invention are equivalent to the advantages of the device that is the subject of the present invention.

BRIEF DESCRIPTION OF THE FIGURES

Other advantages, aims and particular features of the invention will become apparent from the non-limiting description that follows of at least one particular embodiment of the device and method that are the subjects of the present invention, with reference to drawings included in an appendix, wherein.

DESCRIPTION OF THE EMBODIMENTS

The present description is given in a non-limiting way, in which each characteristic of an embodiment can be combined with any other characteristic of any other embodiment in an advantageous way.

Note that the figures are not to scale.

It is noted here that the fluid to be cooled is preferably a gas and, even more preferably, hydrogen. Note that the fluid to be cooled can also be nitrogen, neon or helium in gaseous form. In the rest of the description, when hydrogen is mentioned, this relates to the gas to be cooled. The hydrogen can be replaced by nitrogen, neon or helium.

It is noted here that a cooled gas refers to a gas having a temperature between 70 K and 120 K, and preferably between 78 K and 82 K.

The term "flow comprising at least nitrogen" refers to any fluid flow comprising at least 75% nitrogen. Such a flow can be the air, for example, or be constituted of pure nitrogen.

The term "gaseous flow" is interpreted in a broad sense, and refers to a fluid flow in the gaseous or supercritical state. Depending on the nature of the fluid, the supercritical state is reached when the temperature and pressure conditions are each greater than the values defined in a phase diagram. The temperature and pressure conditions delimiting the supercritical state according to the nature of the fluid are listed in table 1 below:

| Gas | Tc (K) | Pc (bar) |
|---|---|---|
| He (helium) | 5.15 | 2.27 |
| $H_2$ (hydrogen) | 33 | 13 |
| Ne (neon) | 44 | 27.5 |
| $N_2$ (nitrogen) | 126 | 34 |
| $O_2$ (oxygen) | 155 | 50.43 |
| Ar (argon) | 151 | 49 |
| $CH_4$ (methane) | 190 | 46 |
| CO (carbon monoxide) | 132 | 35 |

Tc and Pc correspond to the critical temperature and critical pressure respectively.

For example, nitrogen with a temperature of 221 K at 50 bar is in the supercritical state, while nitrogen with a temperature of 221 K at 33 bar is in the gaseous state.

Figure 1:
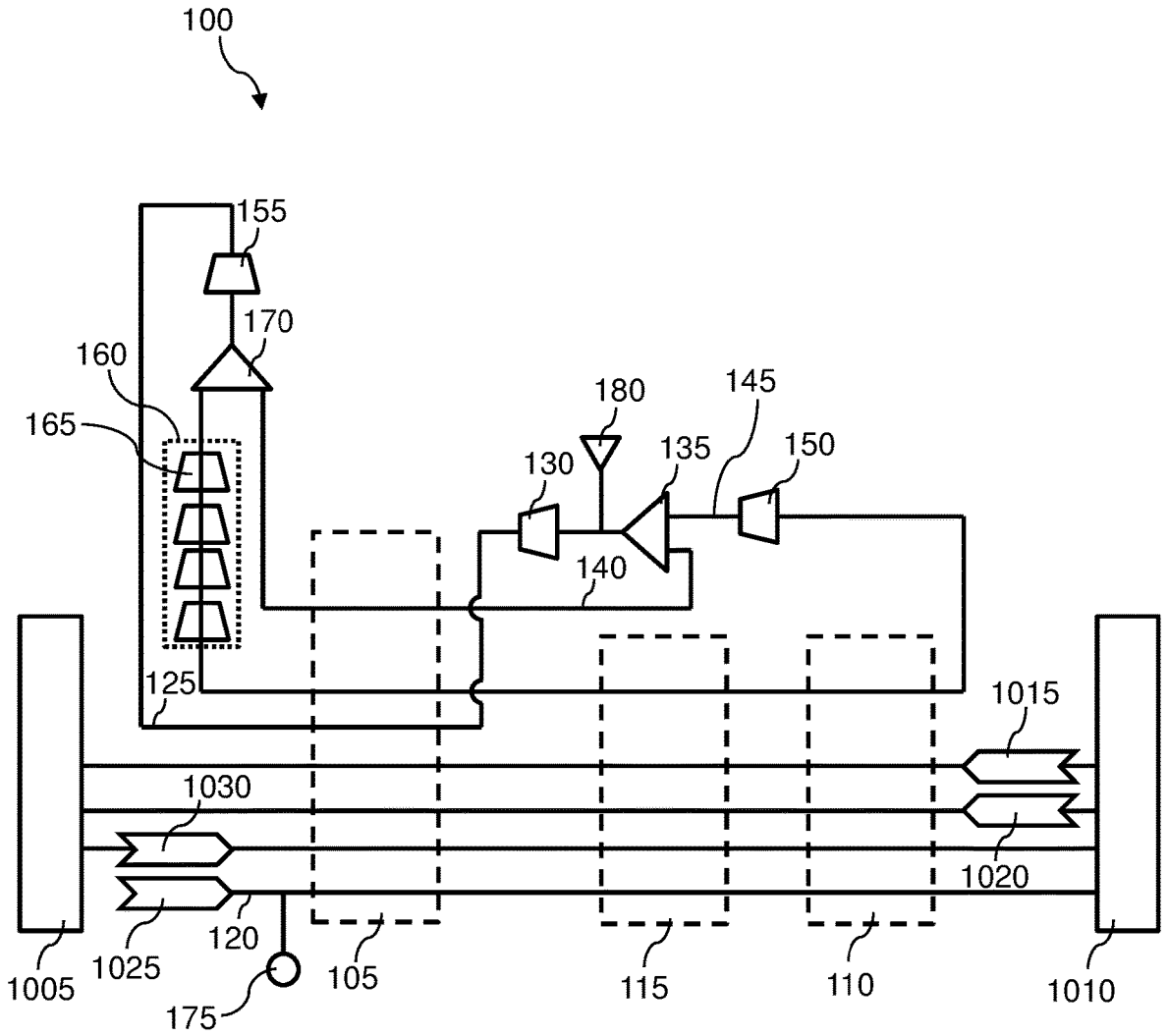
FIG. 1 represents schematically a first particular embodiment of the device that is the subject of the present invention.

FIG. 1, which is not to scale, shows a schematic view of an embodiment of the device 100 that is the subject of the present invention.

Note that this device 100 forms the pre-cooling device of a larger system (not referenced) comprising the systems for transporting, cooling and compressing the fluid to be pre-cooled. In FIG. 1, this system comprises:

- an inlet 1025 for fluid to be cooled, the flow of fluid 120 successively traversing the first heat exchanger 105, the third heat exchanger 115 and the second heat exchanger 110;
- a cooling stage 1010 for cooling the fluid, with two outlets:
- one outlet for low-pressure coolant fluid, which can be the fluid to be cooled, 1020; and
- one outlet for medium-pressure coolant fluid 1015,
- the flows of coolant fluid at low pressure 1020 and at medium pressure 1015 successively traversing the second heat exchanger 110, the third heat exchanger 115 and the first heat exchanger 105 before reaching a compression stage 1005; and
- this compression stage comprising an outlet for high-pressure coolant fluid 1030,
- the flow of high-pressure coolant fluid successively traversing the first heat exchanger 105, the third heat exchanger 115 and the second heat exchanger 110.

Note that devices of the same type, for example compressors of heat exchangers, may be not separate devices but stages of a single device for all or part of the devices of a given type. For example, the first heat exchanger 105, the second heat exchanger 110 and the third heat exchanger 115 can correspond to three distinct stages of a single heat exchanger.

Note that, in some variants, the second heat exchanger 110 is absent from the device 100.

The device 100 for pre-cooling a flow of a fluid comprises:

- downstream from a first coolant flow compressor 155, a first expander 130 of at least one portion of a flow comprising at least nitrogen, referred to as "coolant flow";
- a separator 135 of the coolant flow 125, downstream from the first compressor 155, into two flows:
- one coolant flow 140 referred to as "medium-pressure"; and
- one coolant flow 145 referred to as "low-pressure";
- a first exchanger 105 exchanging heat between the flow 120 of fluid to be pre-cooled and at least the medium-pressure coolant flow 140 comprising at least nitrogen;
- a second expander 150 of the low-pressure coolant flow;
- a second exchanger 110 exchanging heat between the flow of a fluid and the expanded low-pressure coolant flow on output from the second expander;
- a third exchanger 115 exchanging heat between the flow of a fluid and the low-pressure coolant flow on output from the second heat exchanger; and
- at least a first compressor 155 of the expanded low-pressure coolant flow and the medium-pressure coolant flow on output from the first heat exchanger to form the high-pressure coolant flow.

In the embodiment shown in FIG. 1, the separator 135 is positioned downstream from the passage of the coolant flow 125 coming from the first compressor 155 in the first heat exchanger 105, the expander 130 being positioned between the first heat exchanger 105 and the separator 135.

On output from the first heat exchanger 105, the gaseous coolant flow has, for example, a temperature of the order of 221 K at 50 bar. Note that a gaseous coolant flow comprising at least nitrogen is in the supercritical state under the conditions of temperature and pressure respectively equal to 221 K and 50 bar.

The first expander 130 is, for example, an expansion turbine, or turbo-expander. This first expander 130 receives, on input, the high-pressure coolant flow that has traversed the first heat exchanger 105 to be cooled or to reduce its temperature after compression.

In some variants, the first expander 130 is configured, for example, to produce a medium-pressure gaseous coolant flow having a pressure between 15 and 23 bar.

For example, the expansion performed brings the gaseous coolant flow to a pressure of 19 bar and a temperature of 169 K. Note that an expanded gaseous coolant flow comprising at least nitrogen is in the gaseous state under the conditions of pressure and temperature respectively equal to 19 bar and 169 K.

The flow exiting from the first expander 130 is separated in the separator 135. This separator 135 is, for example, a tee equipped with valves enabling the control of the separator 135. In some variants, any type of separator known to the person skilled in the art can be used, depending on the type of implementation of the device 100.

This separator 135 is defined, functionally, by its ability to form the following two flows:

one coolant flow 140 referred to as "medium-pressure"; and one coolant flow 145 referred to as "low-pressure"; where the low pressure is achieved after passage in the second expander 150.

The ratio of separation between the flows, i.e. the proportion of a medium-pressure flow in relation to the low-pressure flow, can be fixed or variable. This ratio can be controlled as a function of a flow rate measured by a sensor (not referenced) detecting the flow rate of the medium-pressure flow 140.

The medium-pressure coolant flow 140 is sent back to the first heat exchanger 105 to take part in the exchanges taking place there, while the low-pressure coolant flow 145 is supplied to the second expander 150.

This second expander is, for example, an expansion turbine, or turbo-expander.

In some variants, the second expander 150 is configured to produce, for example, a low-pressure gaseous coolant flow having a pressure between 1 and 2 bar.

For example, the second expander 150 is configured to bring the gaseous coolant flow to a low pressure having a pressure of 1.4 bar and a temperature of 84 K. Note that a low-pressure gaseous coolant flow comprising at least nitrogen is in the gaseous state under the conditions of pressure and temperature respectively equal to 1.4 bar and 84 K.

Once brought to a low pressure, the low-pressure coolant flow 145 is supplied to the second heat exchanger 110.

This second heat exchanger 110 is, for example, a plate exchanger, spiral exchanger, tube exchanger, shell tube exchanger or finned exchanger.

Once the low-pressure coolant flow 145 has traversed the second heat exchanger 110, this low-pressure coolant flow 145 is directed towards the third heat exchanger 115.

This third heat exchanger 115 is, for example, a plate exchanger, spiral exchanger, tube exchanger, shell tube exchanger or finned exchanger. In some variants, the third heat exchanger 115 is a catalytic exchanger.

The hydrogen is thus converted by a physico-chemical reaction referred to as catalytic and often designated by "catalyst" or "catalysis". This hydrogen catalysis is normally only performed for temperatures below 100 K. This means that in this device 100, if there is catalytic conversion, only the third heat exchanger is catalytic.

Once the low-pressure coolant flow 145 has traversed the third heat exchanger 115, this low-pressure coolant flow 145 is directed towards the first heat exchanger 105.

This first heat exchanger 105 is, for example, a plate exchanger, spiral exchanger, tube exchanger, shell tube exchanger or finned exchanger.

Once the low-pressure coolant flow 145 has traversed the first heat exchanger 105, this low-pressure coolant flow 145 is directed towards the first compressor 155, jointly with the medium-pressure coolant flow 140 on output from the first heat exchanger 105.

The first compressor 155 is, for example, a turbo-compressor, mechanical compressor or alternative.

In some variants, the first compressor 155 is configured to produce a high-pressure gaseous coolant flow having a pressure between 40 and 60 bar.

In some variants not referenced, the device 100 that is the subject of the present invention comprises an absorption column, catalytic or not, positioned on output from the second heat exchanger 110 in the direction of the fluid to be cooled.

On output from the first compressor 155, the high-pressure coolant flow 125 is formed again and sent to the first heat exchanger 105.

Preferably, in the device 100 shown in FIG. 1, the gaseous coolant flow comprising at least nitrogen, downstream from the first compressor 155 and upstream from the first expander 130, is in the supercritical state and has, for example, a pressure between 40 and 60 bar. Next, the gaseous coolant flow comprising at least nitrogen, downstream from the first expander 130, is in the gaseous state and has, for example, a pressure between 15 and 23 bar. In this example, the medium-pressure gaseous coolant flow is therefore in the gaseous state. Lastly, the low-pressure gaseous coolant flow comprising at least nitrogen, downstream from the second expander 150, is in the gaseous state and has, for example, a pressure between 1 and 2 bar.

In some particular embodiments, such as that shown in FIG. 1, the device 100 that is the subject of the present invention comprises, upstream from the first compressor 155, an assembly 160 of at least a second compressor 165 of the low-pressure coolant flow on output from the first heat exchanger 105, the assembly of at least a second compressor being configured such that the low-pressure coolant flow is brought to a pressure equivalent to the pressure of the medium-pressure coolant flow on output from the first heat exchanger.

Each second compressor 165 can be of an identical or different type, of turbo-compressor, mechanical or alternative type.

In some variants not referenced, the device 100 that is the subject of the present invention comprises a sensor (not referenced) detecting the pressure of the medium-pressure coolant flow, the compression assembly 160 being actuated as a function of the pressure captured.

In some particular embodiments, such as that shown in FIG. 1, the device 100 that is the subject of the present invention comprises a mixer 170 of the expanded low-pressure coolant flow and the medium-pressure coolant flow on output from the first heat exchanger 105 to form a single coolant flow, the single flow being supplied to the first compressor 155. The mixer 170 is, for example, a mixing valve or a three-way ball valve.

In some variants not referenced, the mixer 170 is configured the mix the medium-pressure flow with the output flow from a second compressor 165 of the assembly 160 and supply the mixed flow to another second compressor 165 of the assembly 160.

In some particular embodiments, such as that shown in FIG. 1, the device 100 that is the subject of the present invention comprises a sensor 175 detecting the flow rate of a fluid and a regulator 180 regulating the flow rate of the coolant flow, the flow rate regulator being configured such that the flow rate of the coolant flow is equal to 26 to 40 times the flow rate of the fluid. Such a regulator 180 is, for example, a flow rate regulator valve actuated automatically.

The ratio of flow rates is measured as a ratio of overall flows.

The sensor 175 can be of any type of technology suitable for the fluid considered. For example, this sensor 175 is an electromagnetic flowmeter.

In some variants not referenced, the device 100 comprises at least one intermediate exchanger exchanging heat between at least the fluid to be cooled and the low-pressure coolant flow.

In some variants not referenced, the device 100 comprises a plurality of first compressors 155, first expanders 130 and/or second expanders 150.

Figure 3:
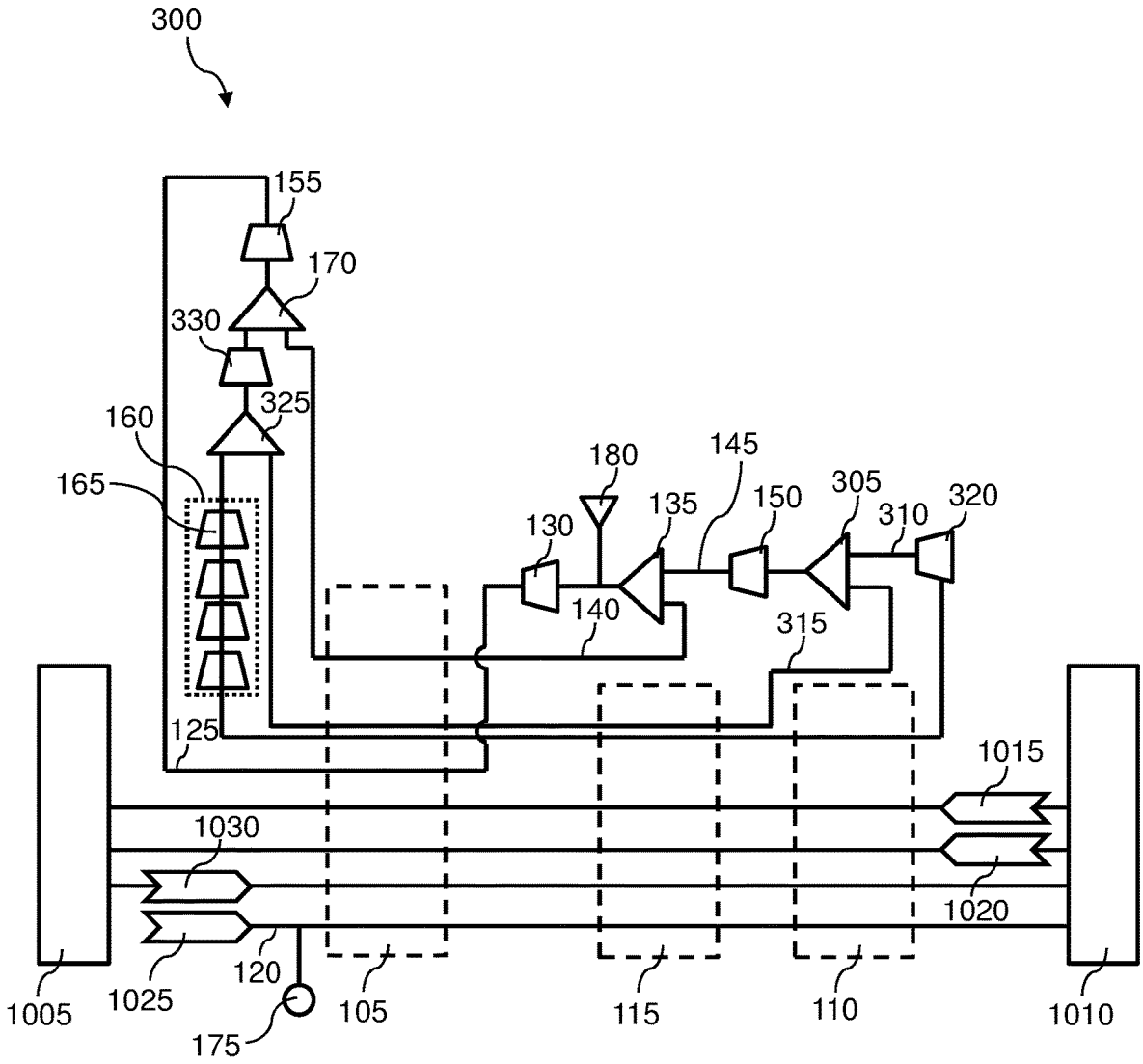
FIG. 3 represents, schematically, a second particular embodiment of the device that is the subject of this invention.

In some variants, such as the one shown in FIG. 3, the device 300 for pre-cooling a fluid flow implements a secondary separator 305 of the low-pressure flow 145, this secondary separator 305 being positioned downstream from the second expander 150. This secondary separator 305 makes it possible to create two flows:

one coolant flow referred to as "low-pressure", 315, corresponding to the flow 145 of FIG. 1, whose pressure is, for example, close to 9 bar; and one coolant flow referred to as "very low-pressure", 310, supplied to an additional expander 320 downstream, whose pressure is, for example, close to 5 bar.

The low-pressure flow 315 is configured to traverse the third exchanger 115 and the first exchanger 105 successively while the very low-pressure coolant flow 310 also traverses the second exchanger 110.

On output from the unit formed by the heat exchangers, 105, 110 and 115, the flows are progressively reintegrated after a number of compression steps corresponding to the number of expansion steps undergone during the cycle.

Thus, the very low-pressure flow 310 is mixed, in a mixer 325, after a possible compression, and the resulting flow is injected into a compressor 330 before being mixed with the medium-pressure flow 140. The resulting flow is supplied to the compressor 155.

In some variants not referenced, the very low-pressure flow 310 is again separated into two flows, one of the two being injected into an expander. The two flows separated in this way then traverse the second exchanger 110.

Preferably, in the device 300 shown in FIG. 3, the gaseous coolant flow comprising at least nitrogen, downstream from the first compressor 155 and upstream from the first expander 130, is in the supercritical state. Next, the gaseous coolant flow comprising at least nitrogen, downstream from the first expander 130 and upstream from the compressor 155, is in the gaseous state.

The implementation of the device 100 makes it possible, for example, to obtain a fluid flow having a temperature of the order of 90 K.

The operational conditions can therefore be such as those described in table 2 below:

| Parameters | Lower limit | Upper limit |
|---|---|---|
| Pressure of the low-pressure coolant flow [bar] | 1 | 2 |
| Pressure of the medium-pressure coolant flow [bar] | 15 | 23 |
| Pressure of the high-pressure coolant flow [bar] | 40 | 62 |
| Total ratio of nitrogen ($kg_{nitrogen}/kg_{fluid\ to\ be\ cooled}$) | 26 | 40 |

-continued

| Parameters | Lower limit | Upper limit |
|---|---|---|
| Medium-pressure flow to low-pressure flow separation ratio | 0.2 | 0.45 |
| Output temperature of the fluid pre-cooled by the device 100 [K] | 80 | 100 |

Figure 4:
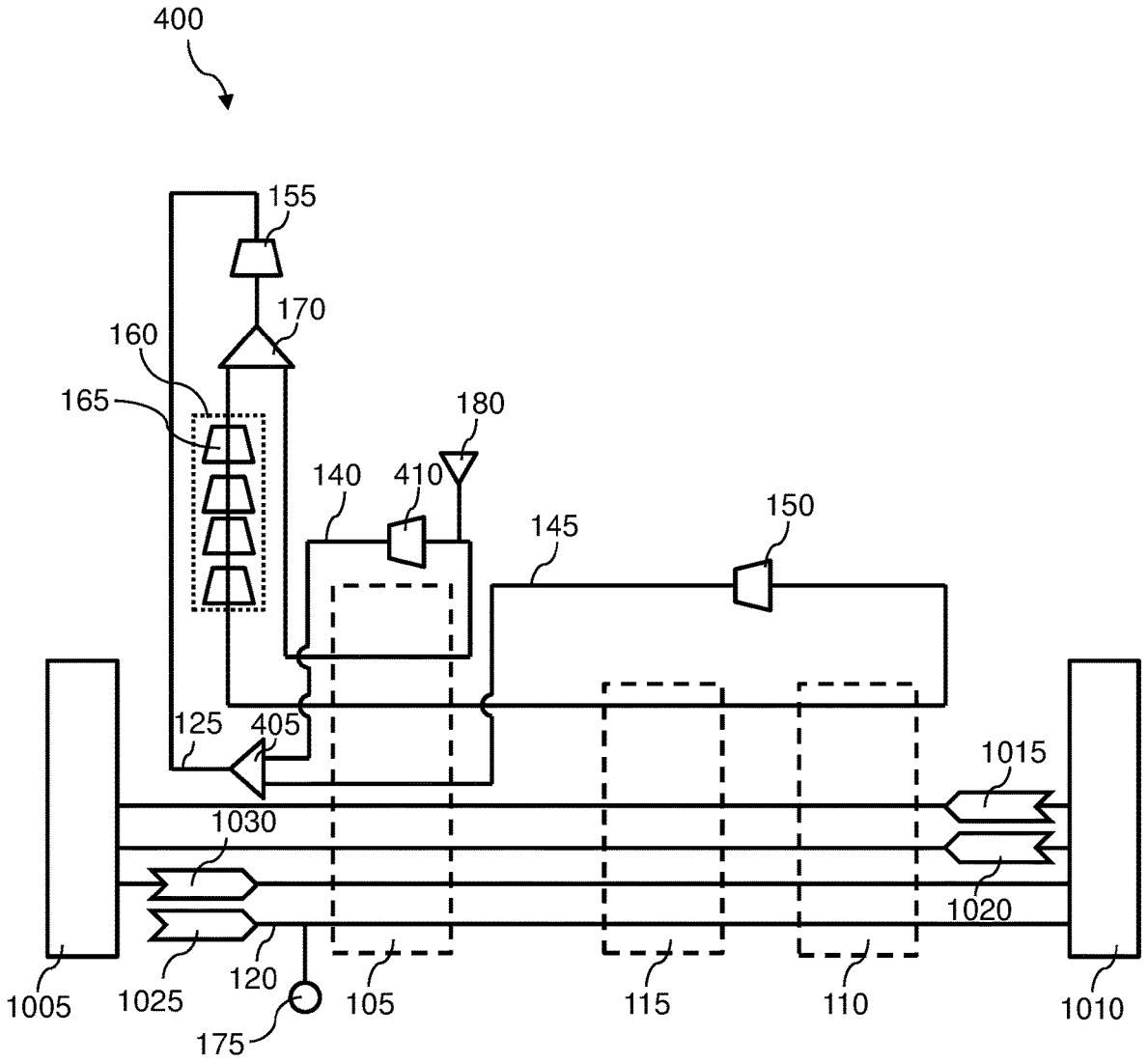
FIG. 4 represents, schematically, a third particular embodiment of the device that is the subject of this invention.

FIG. 4 shows, schematically, a variation of the embodiment shown in FIG. 1. In this particular embodiment of the device 400 that is the subject of the present invention, the separator 405 is positioned upstream from the passage of the coolant flow 125 coming from the first compressor 155 in the first heat exchanger 105, the expander 410 being configured to expand the coolant flow 140 to medium pressure, this expander 410 being positioned between the separator 405 and the first heat exchanger 105.

As can be understood, the main variation is the fact that the first exchanger 105 is no longer shared between the medium- and low-pressure flows, such that the second expander 150 is, in these embodiments, a two-stage expander. The second expander 150 must perform the equivalent of the operations of the first expander 130 and second expander 150 of FIG. 1.

Preferably, in the device 400 shown in FIG. 4, the gaseous coolant flow comprising at least nitrogen, downstream from the first compressor 155 and upstream from the first expander 410 and the second expander 150, is in the supercritical state. Next, the gaseous coolant flow comprising at least nitrogen, downstream from the first expander 410 and second expander 150, is in the gaseous state.

Figure 2:
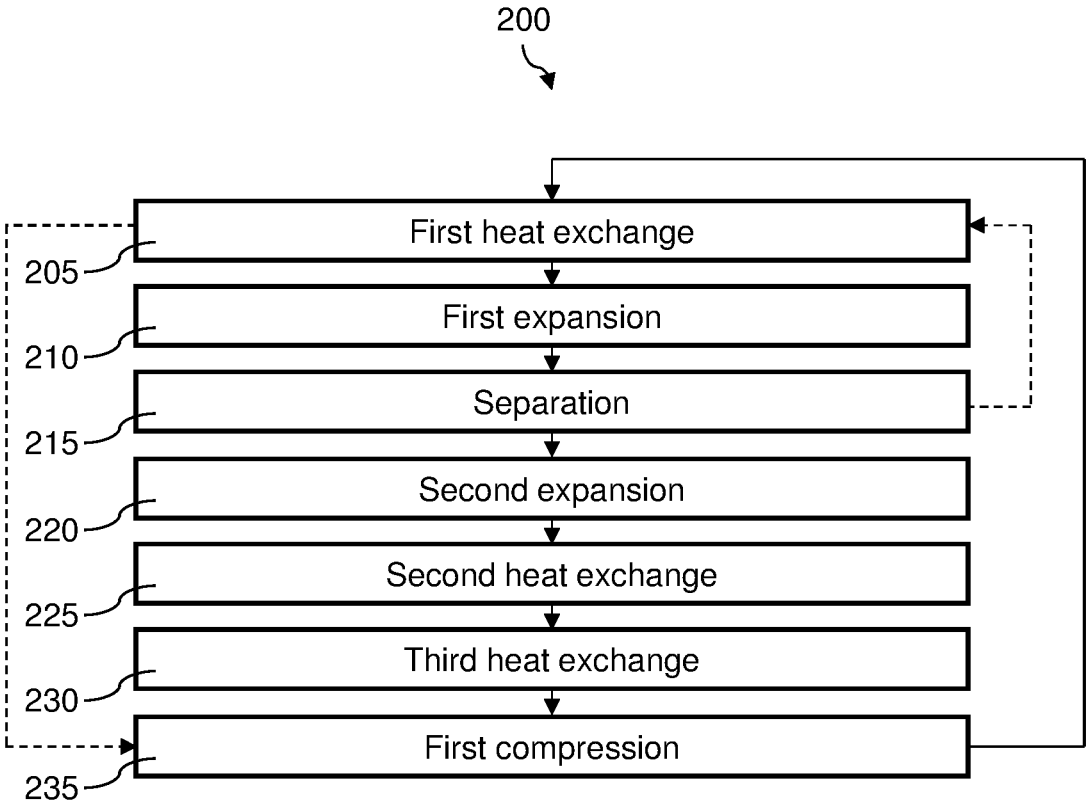
FIG. 2 represents schematically, in the form of a logic diagram, a particular series of steps of the method that is the subject of the present invention.

FIG. 2 shows schematically a particular series of steps of the method 200 that is the subject of the present invention. This method 200 for pre-cooling a flow of a fluid comprises:

downstream from a first step 235 of compressing a flow comprising at least nitrogen, referred to as "coolant flow", a first step 210 of expanding at least one portion of the coolant flow;

a step 215 of separating the coolant flow, coming from the first compression step 235, into two flows:

one coolant flow referred to as "medium-pressure"; and one coolant flow referred to as "low-pressure";

a first step 205 of exchanging heat between the fluid flow to be pre-cooled and at least the medium-pressure coolant flow comprising at least nitrogen;

a second step 220 of expanding the low-pressure coolant flow;

a second step 225 of exchanging heat between the flow of a fluid and the expanded low-pressure coolant flow on output from the second expansion step;

a third step 230 of exchanging heat between the flow of a fluid and the low-pressure coolant flow on output from the second heat exchange step; and at least a first step 235 of compressing the expanded low-pressure coolant flow and the medium-pressure coolant flow on output from the first heat exchange step to form the high-pressure coolant flow, the high-pressure coolant flow being supplied to the first heat exchange step.

The realisation and implementation of this method 200 are described with reference to FIGS. 1, 3 and 4. Similarly, the variants of FIGS. 1, 3 and 4 can be transposed, mutatis mutandis, in the content of FIG. 2.

The invention claimed is:

1. A device for pre-cooling a flow of a gas, comprising:
downstream from a first coolant flow compressor, a first expander of at least one portion of a gaseous flow comprising at least nitrogen, referred to as "coolant flow";
a separator for separating the gaseous coolant flow into two gaseous flows, said separator being positioned downstream from the first coolant flow compressor:
one coolant flow referred to as "medium-pressure"; and
one coolant flow referred to as "low-pressure";
a first exchanger exchanging heat between the flow of gas to be pre-cooled and at least the medium-pressure gaseous coolant flow comprising at least nitrogen;
a second expander of the low-pressure gaseous coolant flow;
a second exchanger exchanging heat between the flow of gas and the expanded low-pressure gaseous coolant flow on output from the second expander;
a third exchanger exchanging heat between the flow of gas and the low-pressure gaseous coolant flow on output from the second heat exchanger; and
the first coolant flow compressor of the expanded low-pressure gaseous coolant flow and the medium-pressure gaseous coolant flow on output from the first heat exchanger to form a high-pressure gaseous coolant flow.

2. The device according to claim 1, wherein the separator is positioned downstream from a passage of the coolant flow coming from the first coolant flow compressor in the first heat exchanger, the first expander being positioned between the first heat exchanger and the separator.

3. The device according to claim 1, wherein the separator is positioned upstream from the passage of the coolant flow coming from the first coolant flow compressor in the first heat exchanger, the expander being configured to expand the coolant flow to medium pressure, this expander being positioned between the separator and the first heat exchanger.

4. The device according to claim 1, which comprises, upstream from the first coolant flow compressor, an assembly of at least a second compressor of the low-pressure coolant flow on output from the first heat exchanger, the assembly of at least a second compressor being configured such that the low-pressure coolant flow is brought to a pressure equivalent to the pressure of the medium-pressure coolant flow on output from the first heat exchanger.

5. The device according to claim 1, wherein the third heat exchanger is a catalytic exchanger.

6. The device according to claim 1, which comprises a mixer of the expanded low-pressure coolant flow and the medium-pressure coolant flow on output from the first heat exchanger to form a single coolant flow, the single flow being supplied to the first coolant flow compressor.

7. The device according to claim 1, wherein the first coolant flow compressor is configured to produce a high-pressure coolant flow having a pressure between 40 and 60 bar.

8. The device according to claim 1, wherein the first expander is configured to produce a medium-pressure coolant flow having a pressure between 15 and 23 bar.

9. The device according to claim 1, wherein the second expander is configured to produce a low-pressure coolant flow having a pressure between 1 and 2 bar.

10. The device according to claim 1, which comprises a sensor detecting the flow rate of a gas and a regulator regulating the flow rate of the coolant flow, the flow rate regulator being configured such that the flow rate of the coolant flow is equal to 26 to 40 times the flow rate of the gas.

11. The device according to claim 1, wherein the pre-cooled gas is dihydrogen.

12. The device according to claim 1, wherein the pre-cooled gas has a temperature between 70 K and 120 K.

13. The device according to claim 12, wherein the pre-cooled gas has a temperature between 78 K and 82 K.

14. A method for pre-cooling a flow of a gas, comprising:
downstream from a first step of compressing a gaseous flow comprising at least nitrogen, referred to as "coolant flow", a first step of expanding at least one portion of the gaseous coolant flow;
a step of separating the gaseous coolant flow into two gaseous flows, the gaseous coolant flow coming from the first compression step:
one coolant flow referred to as "medium-pressure"; and
one coolant flow referred to as "low-pressure";
a first step of exchanging heat between the flow of gas to be pre-cooled and at least the medium-pressure gaseous coolant flow comprising at least nitrogen;
a second step of expanding the low-pressure gaseous coolant flow;
a second step of exchanging heat between the flow of gas and the expanded low-pressure gaseous coolant flow on output from the second expansion step;
a third step of exchanging heat between the flow of gas and the low-pressure gaseous coolant flow on output from the second heat exchange step; and
at least a first step of compressing the expanded low-pressure gaseous coolant flow and the medium-pressure gaseous coolant flow on output from the first heat exchange step to form the high-pressure gaseous coolant flow, a high-pressure gaseous coolant flow being supplied to the first heat exchange step.

* * * * *